United States Patent [19]

Filip

[11] 4,025,748

[45] May 24, 1977

[54] SINGLE PUSH-BUTTON SWITCH HAVING VISUAL POSITION INDICATION

[75] Inventor: Stanislaw F. Filip, Don Mills, Canada

[73] Assignee: I.C.S. Ignition Control Systems Ltd., Montreal, Canada

[22] Filed: July 17, 1975

[21] Appl. No.: 596,846

[52] U.S. Cl. ..... 200/308; 200/157; 200/321

[51] Int. Cl.[2] ..... H01H 13/08

[58] Field of Search ..... 200/308, 157, 318–328, 200/61.85, 50 C

[56] References Cited

UNITED STATES PATENTS

| | | | |
|---|---|---|---|
| 2,918,554 | 12/1959 | Brauneck | 200/50 C |
| 3,392,598 | 7/1968 | Waldorf et al. | 200/328 |

*Primary Examiner*—Robert K. Schaefer
*Assistant Examiner*—Morris Ginsburg
*Attorney, Agent, or Firm*—Finnegan, Henderson, Farabow & Garrett

[57] ABSTRACT

A switch comprising a housing and a switch activating rod extending within the housing. An electrically conductive element is displaceable by the rod within the housing. The rod is resiliently biased axially in one direction to a first position where the conductive element will engage a first set of electrical contacts in the housing. Lock means is provided and associated with the rod for locking the rod in a further position when displaced axially in opposition to the said first position. The conductive element engages a second set of electrical contacts when the rod is locked in the said further position. The rod is unlocked and urged to the first position by depressing the lock means.

8 Claims, 5 Drawing Figures

SINGLE PUSH-BUTTON SWITCH HAVING VISUAL POSITION INDICATION

BACKGROUND OF INVENTION

1. Field of the Invention

The present invention relates to a single push-button switch construction and more particularly to a switch which is easily activated by a push button, which button remains stationary in two switch positions. 2. Description of Prior Art Various types of push button switches are known for performing various type switchings in an electrical circuit. The particular switch construction of the present invention is primarily, although not exclusively, for application on vehicles which are powered by small engines, such as snowmobiles, motorcycles, lawnmowers, etc. There is a need for a simple push-button switch which can be easily activated by movement of the thumb only and when pressed will remain locked in a position and provide clear indication to the operator which of its positions that it is presently in. There is also a need for provision of a simple mechanism for effecting this locking and unlocking of the push button. Further, there is a need to provide a switch which is weather proof and which will provide an economical means of indicating the condition position of the switch.

SUMMARY OF INVENTION

Accordingly, it is a feature fo the present invention to provide a push button switch which substantially meets all of the above requirements.

It is a still further feature of the present invention to provide a push-button switch construction which is totally weather proof, easily operable, and which is provided with indicating means to readily indicate to an operator the position that the switch is in.

According to the above features, from a broad aspect, the present invention provides a switch comprising a housing and a switch activating rod extending within the housing. An electrically conductive element is displaceable by the rod within the housing. The rod is resiliently biased axially in one direction to a first position where the conductive element will engage a first set of electrical contacts in the housing. Lock means is provided and associated with the rod for locking the rod in a further position when displaced axially in opposition to the said first position. The conductive element engages a second set of electrical contacts when the rod is locked in the said further position. The rod is unlocked and urged to the first position by depressing the lock means.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
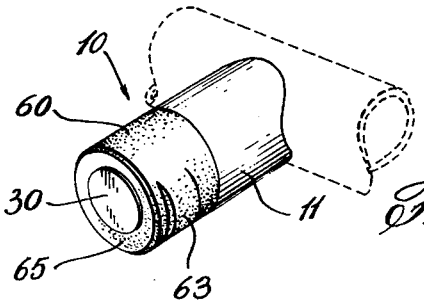
FIG. 1 is a perspective view of the switch in its totally assembled position.
Figure 2:
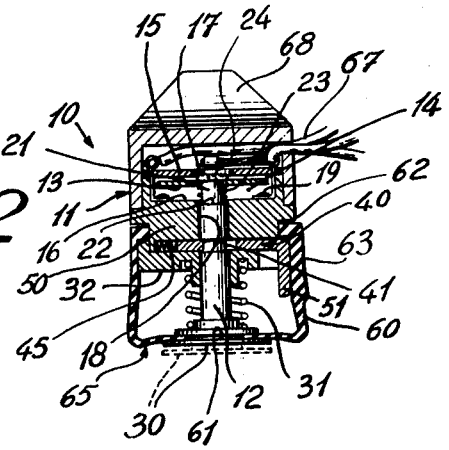
FIG. 2 is a fragmented sectional view of the switch showing the position of the various parts thereof.
Figure 3:
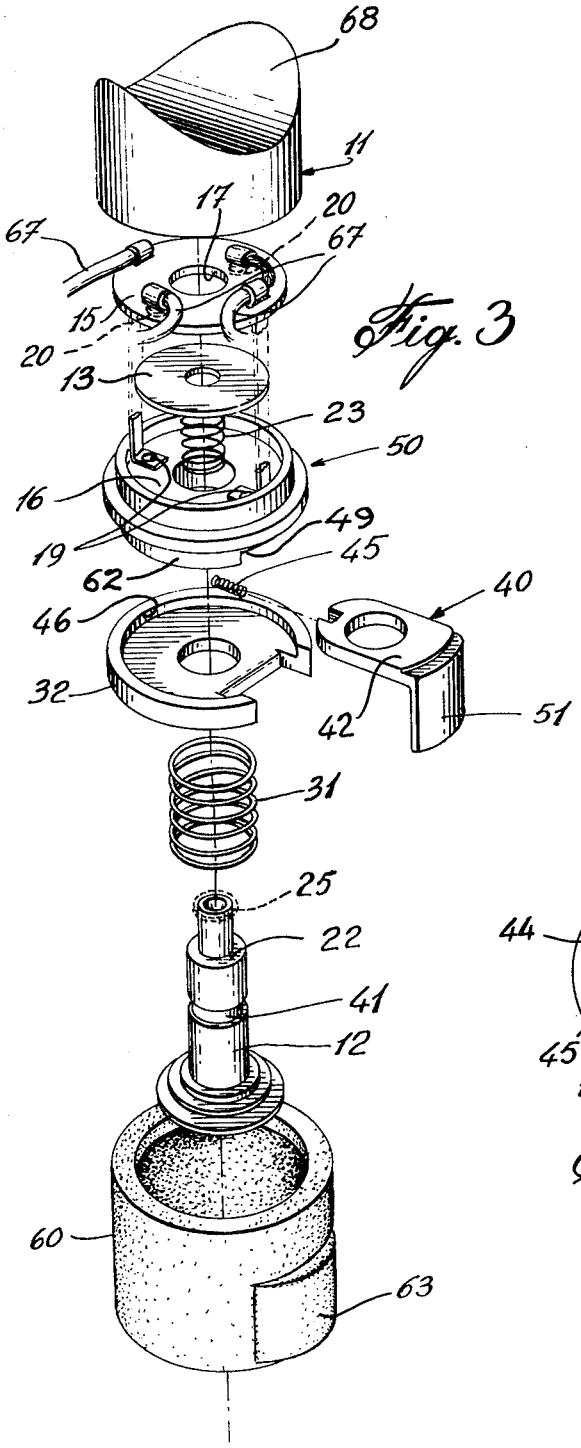
FIG. 3 is an exploded view of the switch construction.

Referring now to the drawings and more particularly to FIGS. 1 to 3, there is shown generally at 10, the switch of the present invention. The switch comprises a housing 11 with a switch activating rod 12 extending within the housing. An electrically conductive element, hereinshown has a flat plate-like annular member 13 (see FIG. 3), is displaceable within a switch contact chamber 14 provided within the housing 11. The switch contact chamber 14 is defined by two spaced apart parallel transverse walls 15 and 16 each having a through bore 17 and 18, respectively formed therein. The through bores 17 and 18 are in alignment with one another and permit the rod 12 to be displaced axially therethrough. A first set of electrical contacts 19 are secured on the surface of the transverse wall 16 whilst a second set of electrical contacts 20 are secured on the surface of the other wall 15. The first and second set of contacts are on opposed inner surfaces of the transverse walls 15 and 16.

The rod 12 has an inner end portion 21 which is of smaller diameter than the major portion of the rod and defines an annular flange 22 about the rod. A first helical spring 23 is positioned about the rod and in abutment at one end thereof with the flange 22 and in abutment at the other end thereof with the flat plate-like member 13. Thus, the flat plate-like member 20 is urged towards the inner end 24 of the rod 12 but prevented from slipping off the rod end 24 by means of a stop element or washer 25 which is secured at the end 24 to limit the travel of the flat plate-like member 13 and to retain the member 13 against the first set of contacts 19 when the rod 12 is biased in a first direction as will be described later. As shown the washer 25 is of smaller diameter than the through bore 17 in the transverse wall 15 to permit passage therethrough.

A flat disc or button element 30 is secured adjacent the other end of the rod 12 externally of the housing 11. The button 30 provides for ease of depressing the rod 12 axially in the housing against the pressure of a second helical spring 31 which is located externally of the housing 11 between an outside wall 32 thereof and the inner face of the button 30. The second helical spring 31 has a compression strength which is higher than the first helical spring 23 whereby the rod 12 is resiliently biased axially in a first direction to a first position where the conductive element or flat plate-like member 13 will engage the first set of electrical contacts 19. By depressing the rod 12 into the housing 11, the end portion 24 of the rod will pass through the through bore 17 in the transverse wall 15 and the conductive element 13 will engage the second set of electrical contacts 20. The rod 12 is locked in this depressed position by lock means 40.

Figure 4:
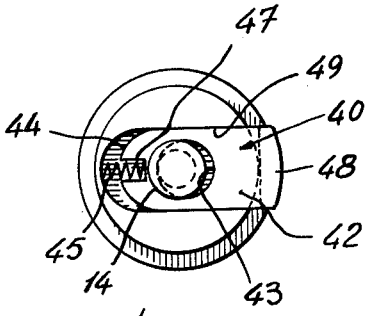
FIG. 4 is a sectional view showing the locking mechanism.

Referring now additionally to FIG. 4, there is shown the construction of the lock means which cooperate with an annular cavity 41 which is positioned in a portion of the rod 12. The lock means is a flat elongated flange member 42 having a through bore 43 extending transversely therein to permit passage of the rod 12 therethrough. The flange member 42 has a spring biased end 44 which is positioned inwardly of the housing and which is biased outwardly of the housing by means of a helical spring 45 or other suitable urging means located between an inner wall 46 of the housing and a small cavity 47 formed within the spring biased end 44. The flange member 42 is further provided with an actuating end 48 which extends outwardly of the housing 11 when the flange is in engagement in the cavity 41. The portion of the flange adjacent the through bore 43 and on the side of the helical spring 45 will enter into the cavity 41 of the rod 12 when the cavity 41 and the flange member 42 are in planar alignment. When this portion of the flange enters a cavity the rod 12 is held in its depressed position with the actuating end 48 moving outwardly of the housing 11.

In order to release the rod 12 from this locked position, it is necessary to depress the actuating end 48 in the direction of the housing whereby to release the rod 14 through the bore 43 when brought into concentric alignment therewith. The pressure in the spring 31 will urge the rod 12 to its first position with the conductive element 13 engaging the first set of contacts 19.

The flange member 42 is maintained in transverse alignment by means of a channel 49 formed on the opposite surface of the member 50 providing the transverse wall 16. Thus, the flange member will move in and out of the housing along a predetermined guided path. As shown in FIG. 2, the actuating end 48 is provided with a downwardly turned flange portion 51 to facilitate finger engagement.

Figure 5:
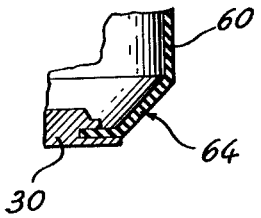
FIG. 5 is a fragmented sectional view of a portion of the switch.

Referring now to FIGS. 1, 2 and 5, there is shown a covering 60 formed of deformable insulating material and sealingly engaged about the button 30 within an annular cavity 61 rearwardly of the front face of the button 30. The other end of the covering 60 is secured in a further annular cavity 62 provided in the outer wall of the member 50 constituting part of the housing 11. The cavity 62 is located above the flange member 42 whereby the actuating end 48 of the flange member 42 is located internally of the covering 40 and preferably located in a depression portion 63 formed internally in the covering 60, as shown in FIG. 1.

FIG. 5 illustrates the configuration of the outer end of the covering 60 when the rod 12 is urged outwardly with the conductive element 13 engaging the first set of contacts 19. It can be seen that the covering extends angularly outward and rearwardly of the button 30, at its forward end, as shown at 64. When the rod or button 30 is depressed within the housing 11, the covering about the button 30 will extend slightly angularly outwards and forwardly of the button 30 as shown at 65 in FIG. 2. Thus, the configuration of the annular portion of the covering 60 about the button 30 gives an indication to the operator of the position of the switch i.e., the button 30 being depressed or not. If the button 30 is depressed, then the actuating end 48 of the flange 42 is pressed inwardly of the housing 11 to cause release of rod 12 and external movement of the button 30 from the housing 11.

The wiring for the contacts is made through the side wall of the housing 11 as shown at 67. Also, the end wall 68 of the housing 11 may be concave whereby to facilitate ease of securement of the housing 11 about a transverse tubular object such as the handle bar of a snowmobile or motorcycle.

To recapitulate briefly, the operation of the switch 10 of the present invention is as follows. The conductive element 13 is normally in contact with a first set of contacts 19 as the rod 12 is biased outwardly of the housing 11 by means of the second helical spring 31 which is of higher compression strength and the first helical spring 23. In order to displace the switch to its second position, where the conductive element 13 is in contact with the second set of contacts 20, the rod is depressed axially inwardly of the housing 11 by means of the end button 30. As soon as the annular cavity 41 in the rod is in alignment with the flange member 42, the flange is urged into locking engagement with the rod with the flange element moving transversely outwardly of the housing by means of the spring pressure applied by the spring 45. Thus, the rod 12 is locked in this position and the conductive element 13 is urged against the second set of contacts 20 by means of the first helical spring 23. In order to disengage the switch from this locked position, it is only necessary to depress the actuating end 48 of the flange member 42 whereby the through bore 43 and flange 42 lies substantially concentric with the rod 12 thus causing the rod to move outwardly of the housing 11 by the compression strength of the second helical spring 31. The position of the rod and thus the position of the conductive element with relation to the first and second sets of contacts, is indicated by the configuration of the annular portion of the covering 60 on the forward end of the switch housing 11.

The first and second set of contacts and the conductive element 13 are made of metallic electrically conductive material. All of the other parts may be constructed of any convenient material to provide proper operation of the switch. The covering 60 hereinshown is made of a very thin rubber material.

I claim:

1. A single push-button switch comprising a housing, a switch activating rod extending within said housing, an electrically conductive element displaceable by said rod within said housing, said rod being resiliently biased axially in one direction to a first position where said conductive element will engage a first set of electrical contacts in said housing, lock means in said housing and associated with said rod for locking said rod in a further position when displaced axially in opposition to said first position, said conductive element engaging a second set of electrical contacts when said rod is locked in said further position, said rod being unlocked and urged to said first position by depressing said lock means, said lock means being a flat elongated flange member having a through bore therein to permit passage of said rod therethrough, said flange member having a spring biased end inwardly of said housing and an actuating end extending outwardly of said housing, said spring biased end urging a portion of said flange member adjacent said through bore against said rod whereby said portion of said flange member will enter a cavity provided in at least a portion of said rod when in planar alignment therewith to maintain said rod in said further position, said flat elongated flange member having finger engagement means at an actuating end thereof and extending to a side of a finger engaging end of said rod to permit unlocking of said rod by depressing said actuating end.

2. A switch as claimed in claim 1 wherein said conductive element is spring locked whereby it is urged against said second set of electrical contacts when said rod is in said further position.

3. A switch as claimed in claim 2 wherein said housing is provided with a switch contact chamber defined by two spaced apart parallel transverse walls, a through bore in each said transverse walls and in alignment with one another to permit said rod to be displaced axially therethrough, said first and second sets of electrical contacts being located on a respective one of inner opposed surfaces of said two transverse walls, said electrically conductive element being a flat plate-like member having a through bore to permit passage of said rod therethrough, said plate-like member being located between said inner opposed surfaces of said two transverse walls.

4. A switch as claimed in claim 3 wherein said rod is provided with a flange below the location of said flat plate-like member, a first helical spring positioned about said rod and being in abutment at one end thereof with said flange and in abutment at the other end thereof with said flat plate-like member.

5. A switch as claimed in claim 4 wherein a second helical spring is located about said rod to provide said rod biasing in said one direction, said second helical spring having a compression strength higher than said first helical spring.

6. A switch as claimed in claim 5 wherein one end of said rod extends externally of said housing, a button element at said one end of said rod for depressing said rod axially in said housing against the pressure of said second helical spring, the other end of said rod having a stop element secured thereto to limit the travel of said flat plate-like member about a portion of said rod to retain said flat plate-like member against said first set of electrical contacts when said rod is biased in said one direction by said second helical spring.

7. A switch as claimed in claim 6 wherein a covering of deformable insulating material is sealingly secured about said button element and an annular cavity in an outer wall of said housing and overlapping said actuating end of said lock means.

8. A switch as claimed in claim 7 wherein said covering extends angularly outward and rearward of said button element in an annular portion thereof when said rod is biased in said one direction, said covering in said annular portion extends slightly angularly outwards and forwardly about said button element when said rod is locked in said further position to serve as an indicator of the position of said button element.

* * * * *